United States Patent [19]

Iskra

[11] 3,985,170

[45] Oct. 12, 1976

[54] SCREWDRIVER

[76] Inventor: Marian Iskra, 20 Little Sutton Road, Four Oaks, Sutton Coldfield, West Midlands, England

[22] Filed: Aug. 4, 1975

[21] Appl. No.: 601,400

[30] Foreign Application Priority Data

Aug. 17, 1974 United Kingdom ..... 36294/74

[52] U.S. Cl. ..... 145/50 A; 145/50 D

[51] Int. Cl.[2] ..... B25B 15/02

[58] Field of Search ..... 145/50 D, 50 C, 50 B, 145/50 A, 50 R

[56] References Cited

UNITED STATES PATENTS

| | | | |
|---|---|---|---|
| 308,247 | 11/1884 | Frearson | 145/50 A |
| 422,307 | 2/1890 | Libbey | 145/50 A |
| 842,107 | 1/1907 | North | 145/50 A |
| 2,173,707 | 9/1939 | Brown | 145/50 A |
| 2,317,319 | 4/1943 | West | 145/50 R |
| 2,366,682 | 1/1945 | West et al. | 145/50 A |
| 2,400,684 | 5/1946 | Clark | 145/50 A |
| 2,417,225 | 3/1947 | West et al. | 145/50 A |
| 3,175,593 | 3/1965 | Launay | 145/50 A |
| 3,424,212 | 1/1969 | Kemper | 145/50 R |
| 3,891,017 | 6/1975 | Iskra | 145/50 A |

FOREIGN PATENTS OR APPLICATIONS

| | | | |
|---|---|---|---|
| 1,476 | 4/1875 | United Kingdom | 145/50 A |
| 455,288 | 2/1950 | Italy | 145/50 A |

*Primary Examiner*—Al Lawrence Smith
*Assistant Examiner*—J. T. Zatarga
*Attorney, Agent, or Firm*—Norris & Bateman

[57] ABSTRACT

Screwdriver provided with a flat blade tip to engage a diametral slot in a screw head and a central guide spigot of square or other non-circular cross section for engagement in an axial guide bore of the screw head, is also provided with a pair of buttresses projecting radially on each side of the tip for abutment or close alignment with the head on each side of the slot. The bit may consist of an axial insert including the spigot and buttresses which is secured in a cross-slot of the blade tip, and the spigot is preferably slightly tapered, and in some applications may extend axially beyond the blade tip.

4 Claims, 3 Drawing Figures

SCREWDRIVER

This invention relates to screwdrivers, particularly hand screwdrivers, although it is contemplated that the invention also has application to screwdriver bits and attachments for use with power tools or in automatic machines and the term "screwdriver bit" is used hereinafter to include hand screwdrivers, bits and attachments except where the context shows otherwise.

The disadvantages of the conventional flat-bladed screwdriver bit used by engagement merely in a diametral slot of the screw head are well known, there is nothing to control axial alignment, slipping can easily occur which may damage surrounding surfaces, and application of out-of-line torque or the use of incorrectly sized, worn, or inaccurately ground bits often causes damage to the screw, making the head unsightly and in some cases making its removal difficult or impossible. In order to overcome these disadvantages various modified forms of screw head and screwdriver bit have been developed, but in many cases these alternative arrangements give rise to other problems, for example the torque of the screwdriver bit may only be transmitted to a specifically shaped recess in a central zone of the head making damage due to excessive force more likely, the specialized bit shapes and head recesses are often expensive and difficult to mass produce, and the shape of the recess usually precludes any safe or successful attempt to use a conventional flat-bladed screwdriver bit should the specialized bit be unavailable.

In my U.S. Pat. No. 3,891,017 I described some forms of screwdriver bit designed to overcome the above disadvantages, but while these have proved successful in use they still left something to be desired by way of durability and ease of manufacture.

The object of the invention is to provide an improved screwdriver bit which is particularly cheap to produce yet which is strong and effective to use, and provides positive and safe driving engagement without risk of slipping and with transmission of maximum torque.

According to the invention a screwdriver bit comprising a straight-edged diametrally extending blade tip for rotational driving engagement with a diametral parallel-sided slot of a screw head, and a central guide spigot of non-circular cross section for engagement in an axial guide bore of said head; is characterised by a pair of buttresses extending radially on each side of the tip for abutment or close alignment with parts of the screw head on each side of the slot.

A preferred embodiment of the invention is now more particularly described with reference to the accompanying drawings, wherein.

Figure 2:
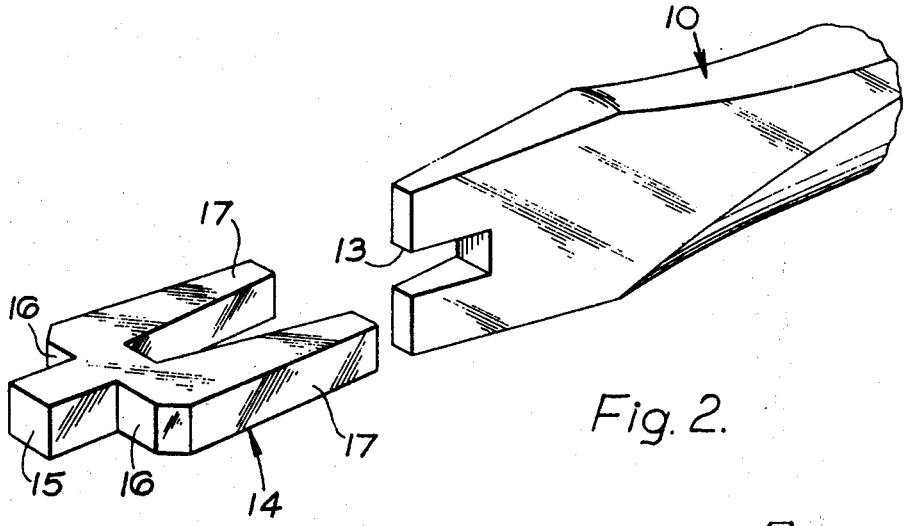
FIG. 2 shows components of the bit.

The bit comprises the normal cylindrical shank 10 (shown broken away) which in the case of a hand screwdriver would mount a handle, or in the case of a bit for a power tool would be operatively received in a chuck, collet or the like. The end of the shank is flattened to provide a diametrally extending blade tip 11, as in the case of an ordinary screwdriver, and has a central slot or notch 13 which extends transversely of the tip (FIG. 2).

Figure 1:
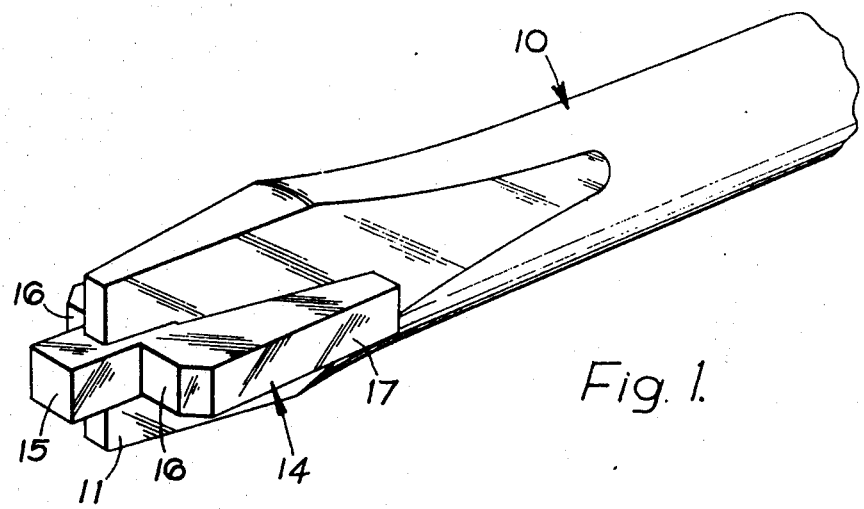
FIG. 1 shows an assembled screwdriver bit.

The slot so formed locates an insert 14 which is pressed, stamped or forged from plate the thickness of slot 13 to provide a square cross-section spigot 15 and a pair of integral buttresses 16. A zone of the insert at which the spigot and buttresses merge is received in slot 13 and each buttress 16 extends away from the blade tip 11 on each flattened side of shank 10 in the form of a pair of generally parallel arms 17. As shown in FIG. 1 the buttresses extend along the flat sides of the tip section and are joined to the spigot by a transverse portion that lies within the notch 13, and are formed adjacent that transverse portion with downwardly facing end surfaces adapted to abut the head of the screw.

The two components (shank 10 and insert 14) are finally secured together, as in FIG. 1, by spot welding, or possibly by brazing or use of a heavy duty adhesive.

Figure 3:
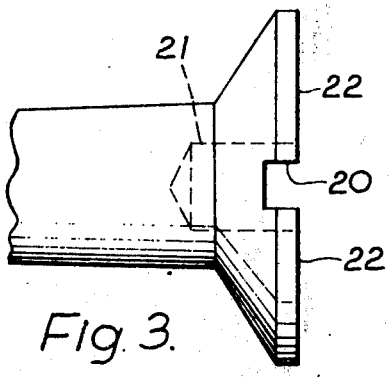
FIG. 3 shows one type of screw head with which the bit is used.

Screws for use with the bit may be countersunk headed as shown in FIG. 3 or have other patterns of head, e.g. cheese-headed, round etc. The screw head has a conventional diametral slot 20 (thus it may if necessary be used with conventional flat bladed screwdrivers) and a central guide bore 21 somewhat deeper than slot 20. It has been found possible to produce screws having this head configuration by a cold-forging process so as to avoid machining and reduce production costs.

The bit mates with the screw by its blade tip 11 being received in slot 20 as with a conventional screwdriver, thus the full torque applied is transmitted at the maximum diameter of the screw; while the diagonal of the square section of spigot 15 is a press fit in guide bore 21 to prevent non-axial misalignment of bit and screw and stop the bit sliding out of slot 20. Preferably spigot 15 is slightly tapered and is so dimensioned that the corners of the square section bite into the bore walls of the screw, thus the screw is securely aligned on the bit which may be used to carry the screw into position. Spigot 15 is not long enough to bottom in bore 21, so ensuring that slot 20 is fully engaged by the blade tip 11. At the same time the radial end faces of the buttresses 16 are brought into abutment or close alignment with the lands 22 of the screw head on each side of slot 20. These buttresses not only strengthen the root of spigot 15 but also provide additional safeguard against non-axial misalignment which might bend or even break off the spigot.

The square cross section spigot is preferred because it has been found to be strong and is easy to manufacture. Both the shank 10 and the insert 14 can be formed entirely by stamping or forging processes, no turning or other machining being necessary (apart possibly from light finish machining) enabling these components to be speedily and cheaply produced.

Spigots of other non-circular cross sections (e.g. oblong or other regular or irregular polygonal sections) may be employed for some applications.

For light duty screws which are normally entered in ready-tapped holes in metal components, e.g. in electrical assemblies, the thickness of the screw head and the diameter of the screw shank may only permit the use of an axial bore which is the same depth as or slightly deeper than the slot in the head, in which case a screwdriver of the invention may be provided with a spigot which does not project axially beyond the blade tip or only projects beyond said tip by a small distance, preferably dimensioned so that it does not "bottom" in the bore.

In other applications, especially for woodscrews, where high driving torque must be transmitted along with substantial axial guidance to "start" the screw and drive it truly home, a spigot having a substantial axial projection beyond the blade tip is to be preferred.

The spaces between the wall of the circular bore and flat side faces of the entered spigot will accommodate any dirt or swarf which may have lodged in the bore e.g. during forming of the screw head.

Having now described my invention, what I claim is:

1. The combination of a screw having a head including a transverse parallel-sided slot and a central axial guide bore of greater depth than the slot and of a diameter greater than the width of the slot; and a screwdriver bit comprising a first component in the form of a shank terminating in a straight-edged flat-sided diametrally extending blade tip for rotational driving engagement with said slot, said blade tip having a centered transverse edge notch, and a second component in the form of an axial insert of which at least part is rigidly secured in said transverse notch, said insert having a central guide spigot of non-circular cross section projecting axially downwardly beyond the blade tip for engagement in said axial guide bore of the screw and a pair of buttresses extending radially outwardly from and longitudinally upwardly along said flat sides of the blade tip, said buttresses being joined to said spigot by a transverse portion extending through said notch and being formed at opposite sides of said transverse portion with downwardly facing end surfaces disposed above said blade tip for abutting the screw head at opposite sides of said slot.

2. The combination of claim 1, in which the guide spigot is of square cross-section having a diagonal dimensioned to be a press fit in said axial guide bore.

3. The combination of claim 2, wherein the insert consists of a flat metal plate element whose thickness is equal to the width of said transverse notch.

4. The combination defined in claim 1, wherein said flat sides of the blade tip are downwardly and inwardly tapered and said buttresses have upwardly and outwardly inclined inner surfaces flush with said flat sides.

* * * * *